US006726504B2

(12) United States Patent
Fuerst et al.

(10) Patent No.: US 6,726,504 B2
(45) Date of Patent: Apr. 27, 2004

(54) ELECTRICAL CONNECTOR FOR CONNECTING FLAT FLEXIBLE CIRCUITRY TO DISCRETE TERMINAL PINS

(75) Inventors: Robert M. Fuerst, West Bloomfield, MI (US); Yves LePottier, Grosse Pointe, MI (US); Brian Richard Moser, Fenton, MI (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/316,819

(22) Filed: Dec. 11, 2002

(65) Prior Publication Data

US 2003/0087549 A1 May 8, 2003

Related U.S. Application Data

(63) Continuation-in-part of application No. 09/804,099, filed on Jun. 22, 2001, now abandoned.

(51) Int. Cl.[7] ..... H01R 12/24
(52) U.S. Cl. ..... 439/496
(58) Field of Search ..... 439/495, 496, 439/494, 460, 267, 268, 67

(56) References Cited

U.S. PATENT DOCUMENTS 3,082,398 A * 3/1963 Valch ..... 439/496
3,319,216 A 5/1967 McCullough ..... 339/176
3,336,565 A * 8/1967 Crimmins ..... 439/496
4,248,491 A * 2/1981 Mouissie ..... 439/495
4,684,183 A * 8/1987 Kinoshita et al. ..... 439/496
6,000,951 A * 12/1999 Hansen et al. ..... 439/496
6,077,124 A * 6/2000 Etters et al. ..... 439/496
6,280,241 B2 * 8/2001 Herlinger et al. ..... 439/496

FOREIGN PATENT DOCUMENTS

EP 0 866 520 A2 9/1998 ..... H01R/9/07

* cited by examiner

*Primary Examiner*—Renee Luebke
*Assistant Examiner*—Felix O. Figueroa
(74) *Attorney, Agent, or Firm*—Stacey E. Caldwell

(57) ABSTRACT

A connector is provided for electrically interconnecting the conductors of a flat flexible circuit to a plurality of discrete terminal pins. The connector includes a dielectric housing having a front mating face and a rear terminating face. A plurality of terminal pin-receiving passages are provided in the mating face. A flat circuit-receiving receptacle is provided in the terminating face in communication with the passages. A circuit carrier or spring member is insertable into the receptacle of the housing and includes an attachment portion for attaching the flat flexible circuit of the carrier with the conductors of the circuit facing away from the carrier toward the terminal pin receiving passages. Insertion of the pins in the passages causes the pins to engage the conductors of the circuit. The circuit carrier or spring member includes a spring loaded mouth into which the terminal pins are inserted into engagement with the conductors of the circuit. Cam means are provided to open the spring loaded mouth a given amount to apply a given contact force between the terminal pins and the conductors of the circuit.

23 Claims, 16 Drawing Sheets

14
90
104
86
38
44
42
94b
96a
48
96
50
94
92
94a
E
F
102

ELECTRICAL CONNECTOR FOR CONNECTING FLAT FLEXIBLE CIRCUITRY TO DISCRETE TERMINAL PINS

RELATED APPLICATION

This is a continuation-in-part of application Ser. No. 09/804,099 which was filed on Jun. 22, 2001 now abandoned and which is assigned to the assignee of the present application.

FIELD OF THE INVENTION

This invention generally relates to the art of electrical connectors and, particularly, to connectors for electrically interconnecting a plurality of discrete terminal pins to the conductors of a flat flexible circuit.

BACKGROUND OF THE INVENTION

A flat flexible circuit conventionally includes an elongated flat flexible dielectric substrate having laterally spaced strips of conductors on one or both sides thereof. The conductors may be covered with a thin, flexible protective layer on one or both sides of the circuit. If protective layers are used, cutouts are formed therein to expose the underlying conductors at desired contact locations where the conductors are to engage the conductors of a complementary mating connecting device which may be a second flat flexible circuit, a printed circuit board or the terminals of a mating connector.

A wide variety of connectors have been designed over the years for terminating or interconnecting flat flexible circuits with complementary mating connecting devices. However, there has not been a reliable and cost effective system for electrically connecting a plurality of discrete terminal pins to flat flexible circuitry. The present invention is directed to satisfying that need and solving the problems associated therewith. The present invention is extremely simple, inexpensive and reliable.

SUMMARY OF THE INVENTION

An object, therefore, of the invention is to provide a new and improved electrical connector for interconnecting the conductors of a flat flexible circuit to a plurality of discrete terminal pins.

In the exemplary embodiment of the invention, the connector includes a dielectric housing having a front mating face and a rear terminating face. The front mating face has a plurality of terminal pin-receiving passages. The terminating face has a flat circuit-receiving receptacle which is in communication with the passages. A circuit carrier or spring member is insertable into the receptacle and includes an attachment portion for attaching the flat flexible circuit to the carrier, with the conductors of the circuit facing away from the carrier toward the terminal pin-receiving passages. Insertion of the pins into the passages causes the pins to engage the conductors of the circuit.

The circuit carrier preferably is fabricated of metal material and includes a spring loaded mouth into which the terminal pins are inserted into engagement with the conductors of the circuit. The housing includes cam means engageable with the circuit carrier to open the spring loaded mouth a given amount to apply a given contact force between the terminal pins and the conductors of the circuit. Complementary interengaging latch means are provided between the circuit carrier and the housing to hold the carrier in the receptacle of the housing. The leading edge about which the flat flexible circuit is wrapped is a thin or abrupt edge which provides an interference engagement with the flat flexible circuit to retain the circuit supported by the circuit carrier or spring member.

As disclosed herein, at least a portion of the circuit carrier is generally U-shaped to define a pair of legs. A first of the legs forms the attachment portion of the carrier. A second of the legs forms a mounting portion for mounting the circuit carrier in the housing. The first leg has a leading edge about which the flat flexible circuit is wrapped, with the conductors of the circuit facing away therefrom. A raised area is provided immediately inside the leading edge of the first leg and over which the flat flexible circuit is wrapped. The raised area forms contact portions of the terminals for engaging the terminal pins. The raised area may be provided by a yieldable backing strip adhered to the first leg. The distal ends of the legs define the mouth into which the terminal pins are inserted. The cam means for opening the mouth comprises at least one cam ramp on the housing for engaging the first leg of the circuit carrier to open the mouth automatically in response to inserting the circuit carrier into the receptacle in the housing.

In one embodiment of the invention, the cam means which is engageable with the circuit carrier or spring member to open the spring loaded mouth thereof is integral with the housing. In a second embodiment, the cam means is integral with a preload member which is separate from the dielectric housing. The preload member is mounted on the housing for movement between a preassembly position wherein the cam means is out of engagement with the spring member and a preload position wherein the cam means is in engagement with the spring member opening the spring loaded mouth thereof.

As disclosed herein, the separate preload member is slidably mounted in an opening at the front mating end of the housing for movement between the preassembly and preload positions. The preload member includes a plurality of terminal pin receiving passages. The conductors of the flat flexible circuit are spaced laterally thereof, and the terminal pin receiving passages are aligned with the conductors. The cam means is provided by a plurality of individual cams located between the terminal pin receiving passages. Finally, detent means are provided between the preload member and the housing to hold the preload member in either of the preassembly or preload positions.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 3:
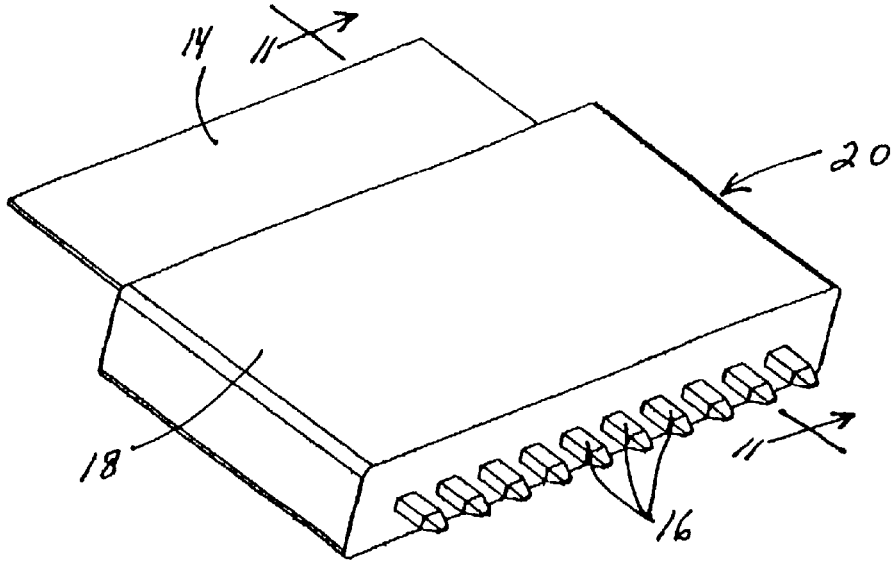
FIG. 3 is a top perspective view of the assembly of FIG. 1 in mated condition.
Figure 4:
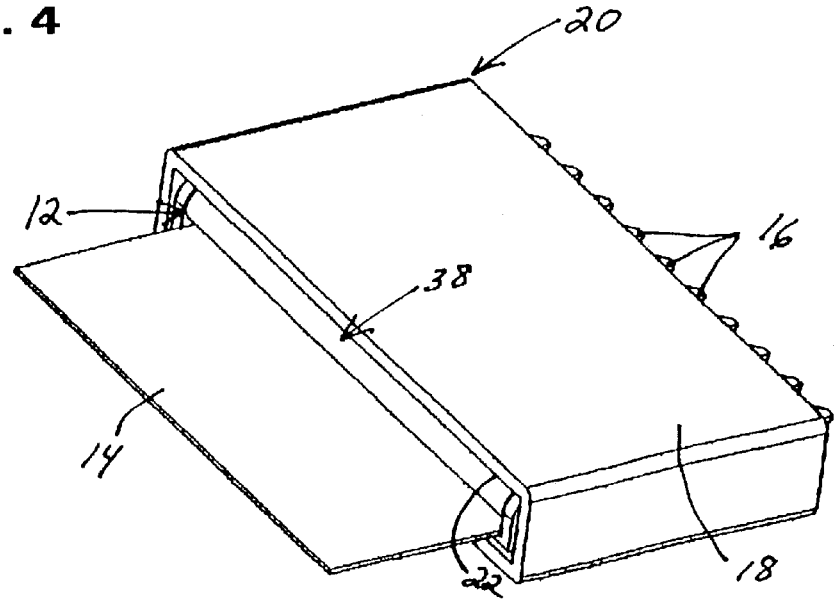
FIG. 4 is a bottom perspective view of the mated assembly of FIG. 3.

Referring to the drawings in greater detail, and first to FIGS. 1–4, the invention is embodied in a first embodiment of an electrical connector, generally designated 12, for electrically interconnecting the conductors of a flat flexible circuit 14 to a plurality of discrete terminal pins 16. As shown herein, terminal pins 16 are mounted in a housing 18 of a complementary mating header connector, generally designated 20. The terminal pins extend into the interior of a cavity 22 within housing 18 of header connector 20. Hereinafter, connector 12 according to the invention will be called the "circuit connector". The circuit connector is mateable with header connector 20 in the direction of arrows "A" (FIGS. 1 and 2), by inserting the circuit connector into cavity 22 of header connector 20 as seen in FIGS. 3 and 4.

Figure 5:
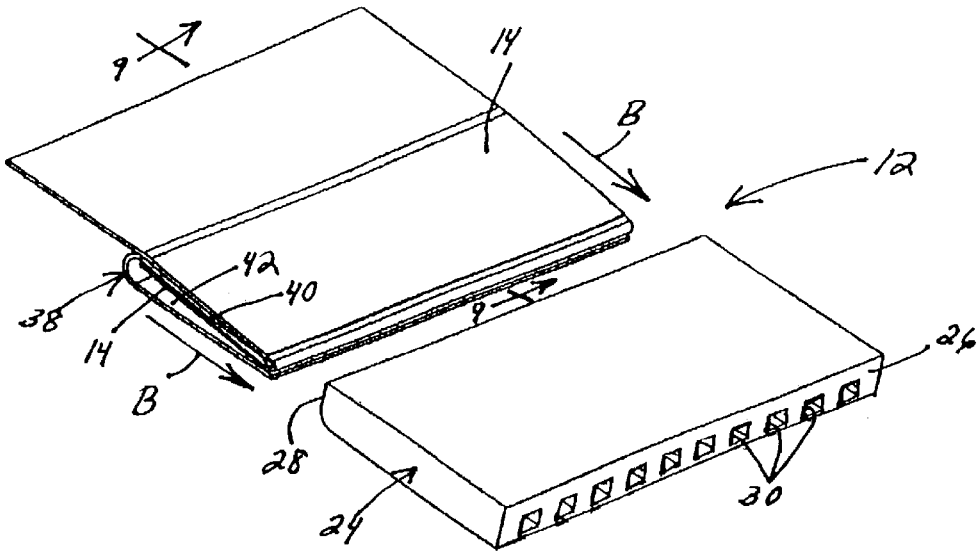
FIG. 5 is a top perspective view of the first embodiment of the connector of the invention in unassembled condition.
Figure 6:
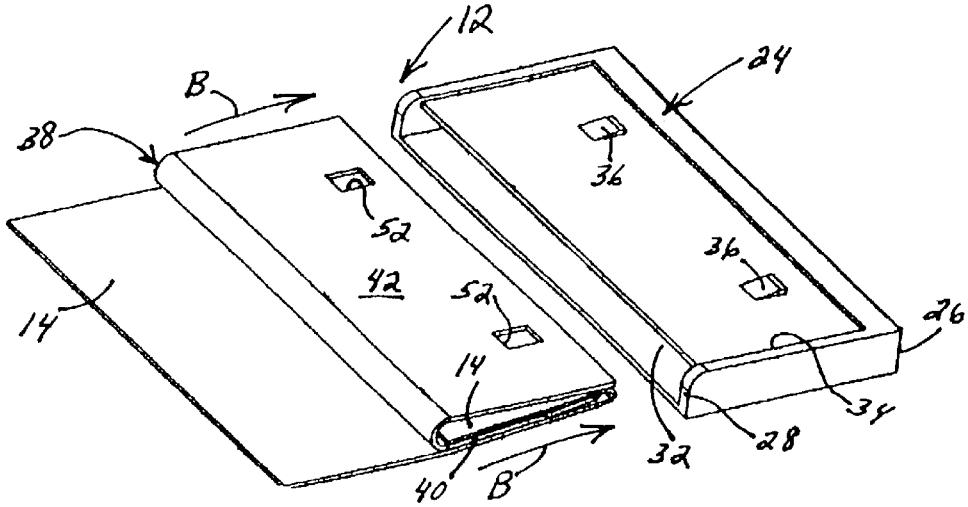
FIG. 6 is a bottom perspective view of the unassembled connector of FIG. 5.

Referring to FIGS. 5 and 6 in conjunction with FIGS. 1–4, circuit connector 12 includes a dielectric housing, generally designated 24, having a front mating face 26 and a rear terminating face 28. A plurality of terminal pin receiving passages 30 (FIG. 5) are provided in mating face 26. A flat circuit receiving receptacle 32 (FIG. 6) is provided in rear terminating face 28. As will be seen hereinafter, the receptacle communicates with passages 30. A recessed area 34 is formed in the bottom of housing 24. Finally, a pair of ramped latch bosses 36 project from the housing within recessed area 34 as seen in FIG. 6. Housing 24 may be molded of plastic material.

Figure 7:
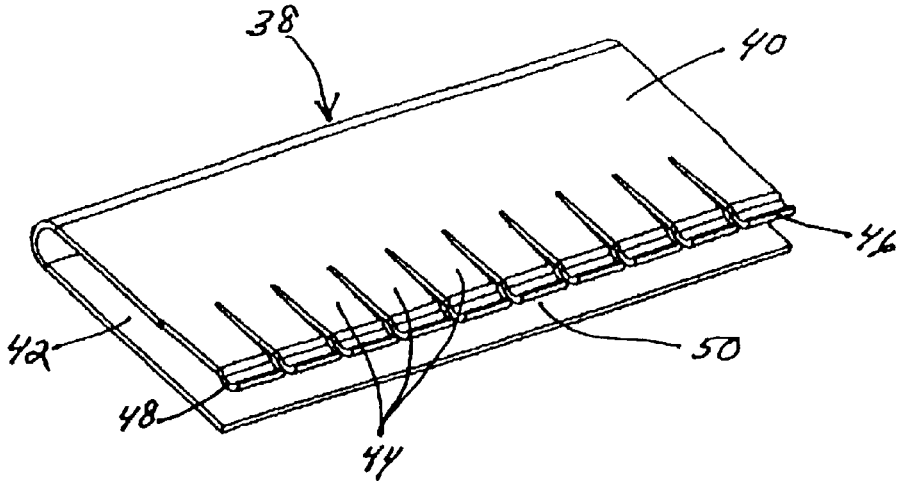
FIG. 7 is a top perspective view of the circuit carrier of the connector.
Figure 8:
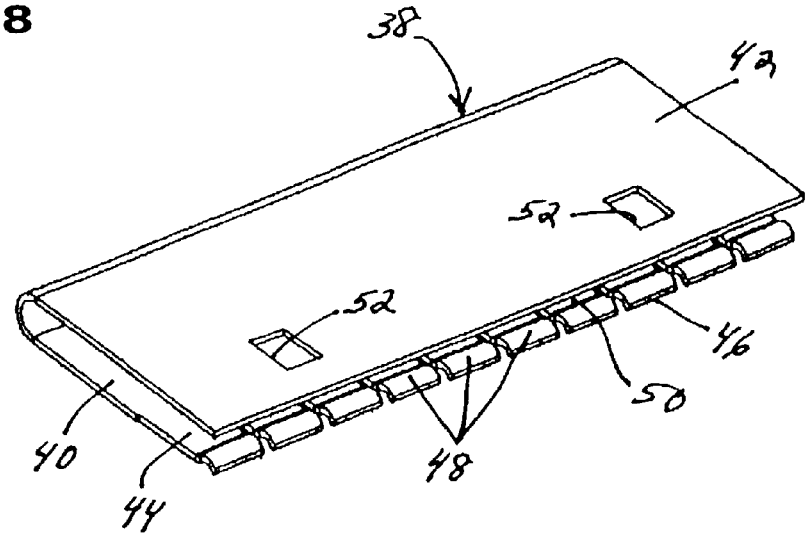
FIG. 8 is a bottom perspective view of the circuit carrier.

Referring to FIGS. 7 and 8 in conjunction with FIGS. 5 and 6, circuit connector 12 includes a circuit carrier, generally designated 38, which is insertable into receptacle 32 in housing 24 in the direction of arrows "B" (FIGS. 5 and 6). The circuit carrier is fabricated of a metal material having spring loading capabilities. The circuit carrier is generally U-shaped to define a top leg 40 and a bottom leg 42. Top leg 40 forms an attachment portion of the carrier about which flat flexible circuit 14 is wrapped as seen in greater detail hereinafter. The top leg has a plurality of flexible or resilient fingers 44 which combine to form a composite leading edge 46 about which circuit 14 is wrapped, with the conductors (not shown) of the circuit facing away from the carrier toward pin-receiving passages 30 of housing 24 when the circuit carrier and circuit are inserted into receptacle 32 of the housing. Fingers 44 have raised areas 48 which face inwardly toward bottom leg 42. The raised areas define convex surfaces which form contact portions behind the conductors of the flat flexible circuit for providing good engagement with terminal pins 16. In essence, a mouth 50 is defined between legs 40 and 42 at the distal ends thereof inside raised areas 48. Finally, circuit carrier 38 includes a pair of latch apertures 52 (FIG. 8) for interengagement with latch bosses 36 (FIG. 6) of housing 24 to hold the circuit carrier in receptacle 32 of the housing as seen best in FIG. 2. It also can be seen in FIG. 2 that, when the circuit carrier is assembled within the housing, bottom wall 42 of the circuit carrier is disposed within recessed area 34 generally flush with the bottom of the housing.

Figure 9:
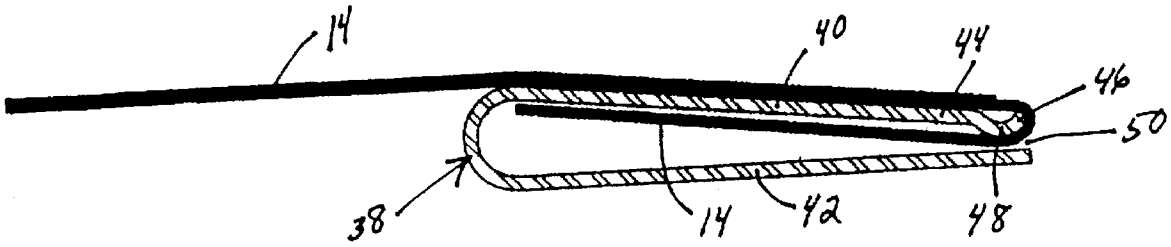
FIG. 9 is an enlarged section taken generally along 9—9 of FIG. 5.
Figure 10:
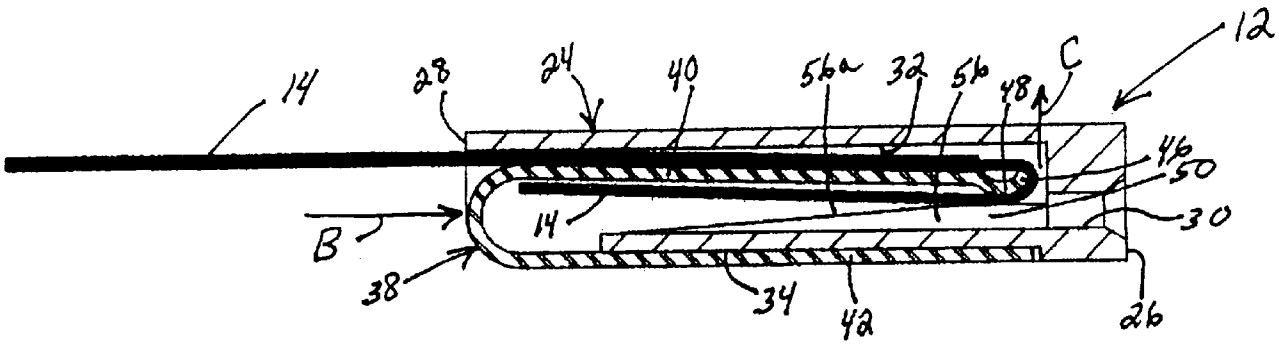
FIG. 10 is an enlarged section taken generally along line 10—10 in FIG. 1.
Figure 11:
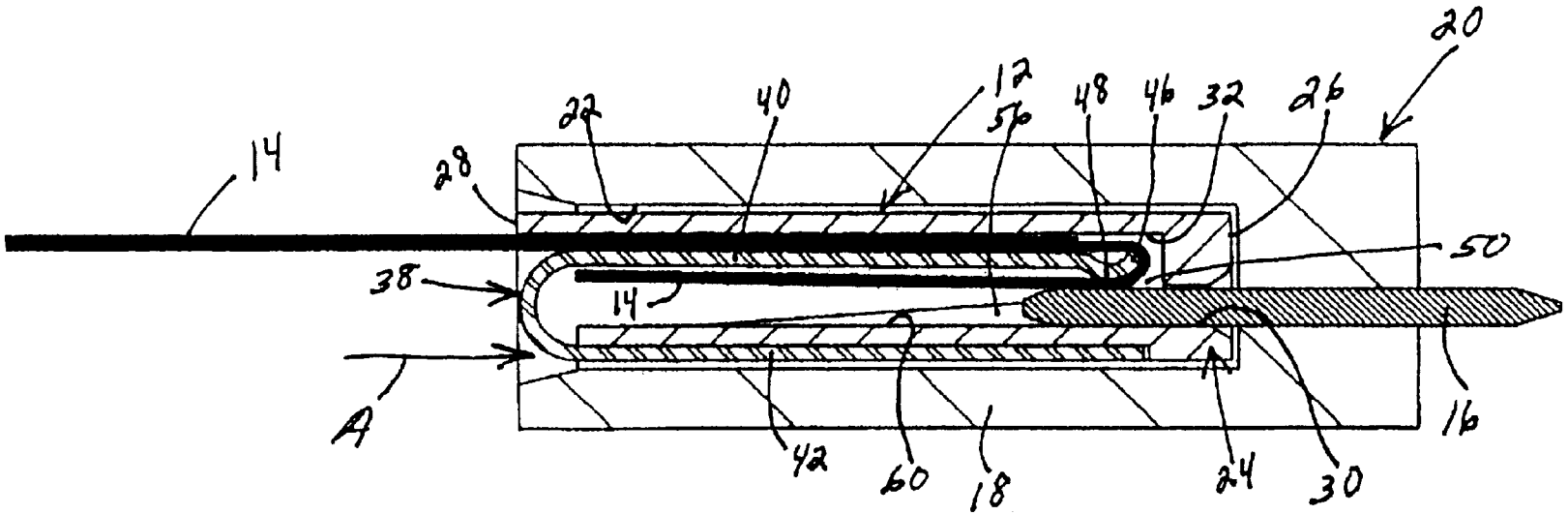
FIG. 11 is an enlarged section taken generally along line 11—11 of FIG. 3.

FIGS. 9–11 show the sequence of assembly of circuit connector 12 and the mating of the circuit connector within cavity 22 of header connector 20. Specifically, FIG. 9 shows flat flexible circuit 14 wrapped about leading edge 46 of leg 40 of circuit carrier 38. It can be seen that raised areas 48 of fingers 44 extend the flexible circuit inwardly immediately inside edge 46 at the distal end of leg 40. FIG. 9 also shows the metal circuit carrier in an unstressed condition, wherein the distal ends of legs 40 and 42 are relatively close to each other, whereby mouth 50 is relatively narrow.

FIG. 10 shows the subassembly of circuit carrier 38 and flat flexible circuit 14 having been inserted in the direction of arrow "B" into receptacle 38 of housing 24. When inserted, bottom leg 42 of the circuit carrier is disposed within recessed area 34 at the bottom of the housing. FIG. 10 also shows a cam means within receptacle 32 of the housing for engaging top leg 40 and flat circuit 14 to expand or open mouth 50. Specifically, a plurality of elongated cam ramps 56 are formed within the housing and are located between the plurality of pin-receiving passages 30 so that the cam ramps do not interfere with insertion of the pins into the circuit connector. The cam ramps define inclined surfaces 56*a* which engage raised areas 48 at leading edge 46 of top leg 40 to bias the top leg upwardly in the direction of arrow "C". Actually, the cam ramps engage the overwrapped flexible circuit between the conductors of the circuit. Nevertheless, with bottom leg 42 of the circuit carrier fixed against the bottom of housing 24, raising top leg 40 in the direction of arrow "C" stores energy in the top leg of spring metal material, effectively spring-loading the leg.

FIG. 11 shows circuit connector 12 having been inserted in the direction of arrow "A" into cavity 22 of housing 18 of header connector 20. Upon mating of the connectors as shown, terminal pins 16 enter passages 30 in mating face 26 of housing 24 of the circuit connector. The terminal pins move into mouth 50 and engage the conductors on the outside of flat flexible circuit 14 which has been wrapped about leading edge 46 of top leg 40 of circuit carrier 38. The pins ride along a rigid interior bottom wall 60 of the housing within receptacle 32. The cross-dimensions of the pins are sufficiently greater than the distance between bottom wall 60 and raised areas 48 to create a good positive electrical contact between the terminal pins and the conductors on the outside of flat flexible circuit 14 which has been wrapped around leading edge 46 of top leg 40 of the circuit carrier.

From the foregoing, it can be understood that the connector of the invention has a number of advantages. A key advantage is the ability of circuit carrier 38, with its opposing legs 40 and 42, to contain all required normal forces within a single component, thereby eliminating stress relaxation of other components such as plastic housing 24. This is especially important as the number of terminal pins increases, because the total normal force of the system also increases. Preloading the circuit carrier has the advantage of generating high normal forces with minimal displacement of leg 40 of the carrier. Insertion forces also are reduced because the terminal pins are not used to spread the legs of the circuit carrier from its unstressed condition. Still further, moving the leading edge of the flexible circuit away from the tips of the terminal pins reduces skiving damage upon initial insertion of the terminal pins into the connector.

Figure 12:
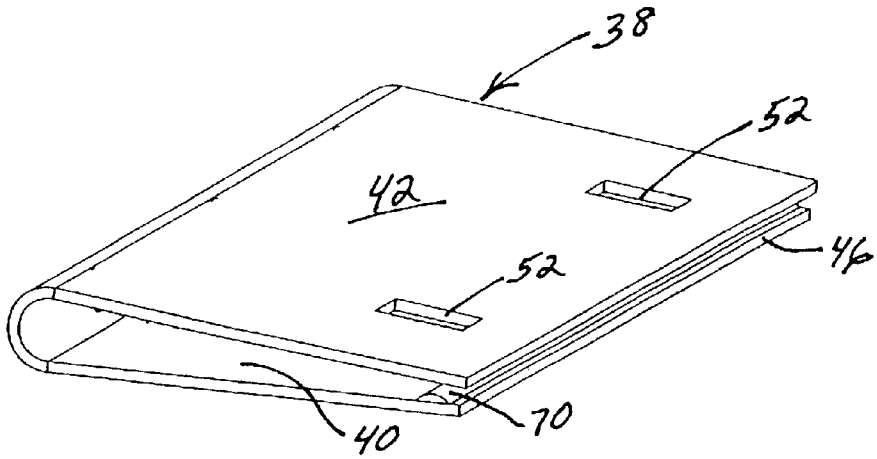
FIGS. 12 and 13 are views similar to FIGS. 8 and 7, respectively, but showing a different circuit carrier wherein the resilient fingers have been replaced by a resilient backing structure.
Figure 13:
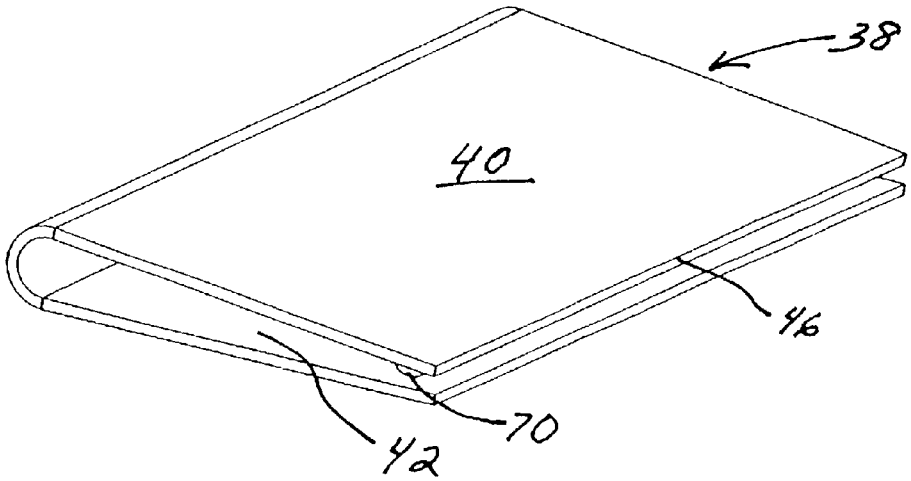

FIGS. 12 and 13 show an alternate embodiment of circuit carrier 38, and like reference numerals have been applied in FIGS. 12 and 13 corresponding to like components already described in relation to FIGS. 1–11. In particular, resilient fingers 44 (FIGS. 7 and 8) have been replaced by a yieldable backing structure or strip 70 of elastomeric material such as silicone rubber or the like. The yieldable backing strip is attached or adhered, as by appropriate adhesive, to the inside of leg 40 of the circuit carrier immediately inside edge 46 of the leg. Yieldable backing strip 70 performs the resiliency function of flexible fingers 44 as well as providing the raised area 48 of the first embodiment.

Figure 1:
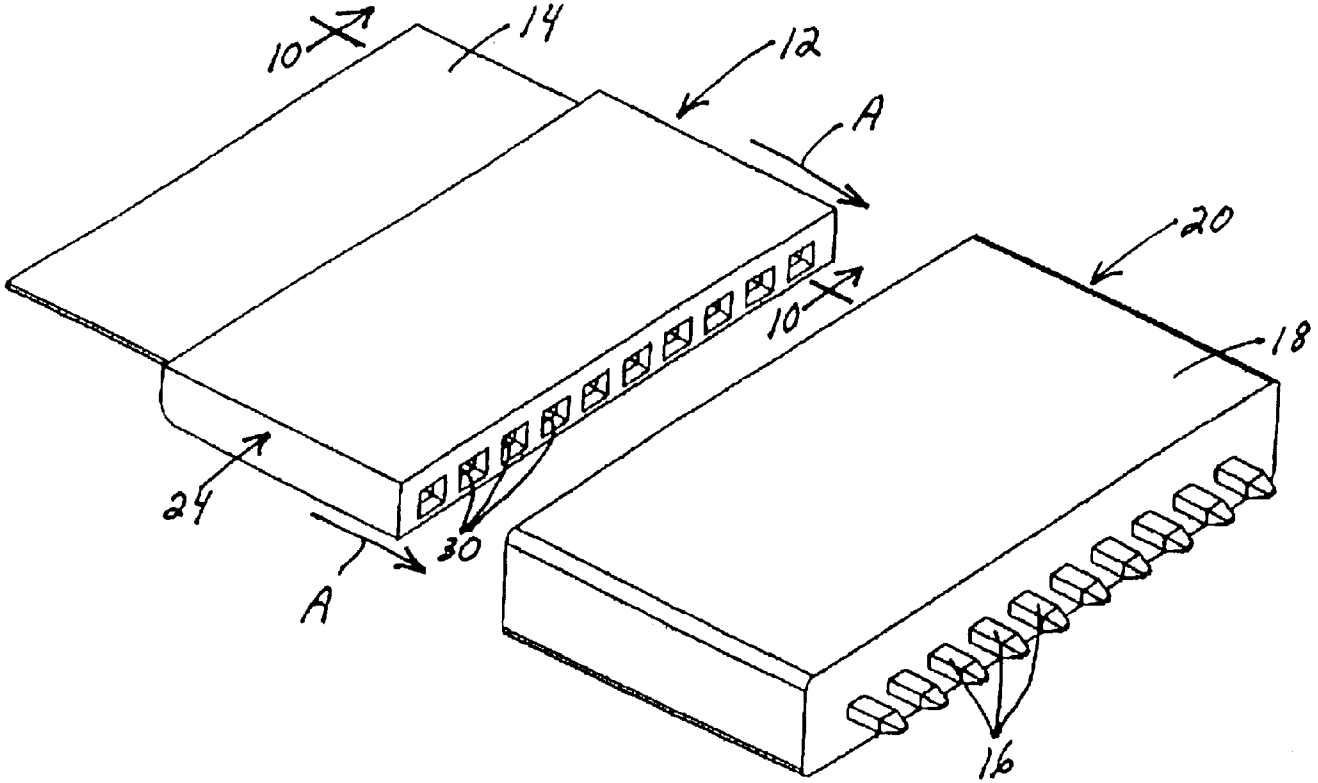
FIG. 1 is a top perspective view of a connector assembly including a first embodiment of the connector of the invention in unmated condition relative to a complementary mating header connector.
Figure 2:
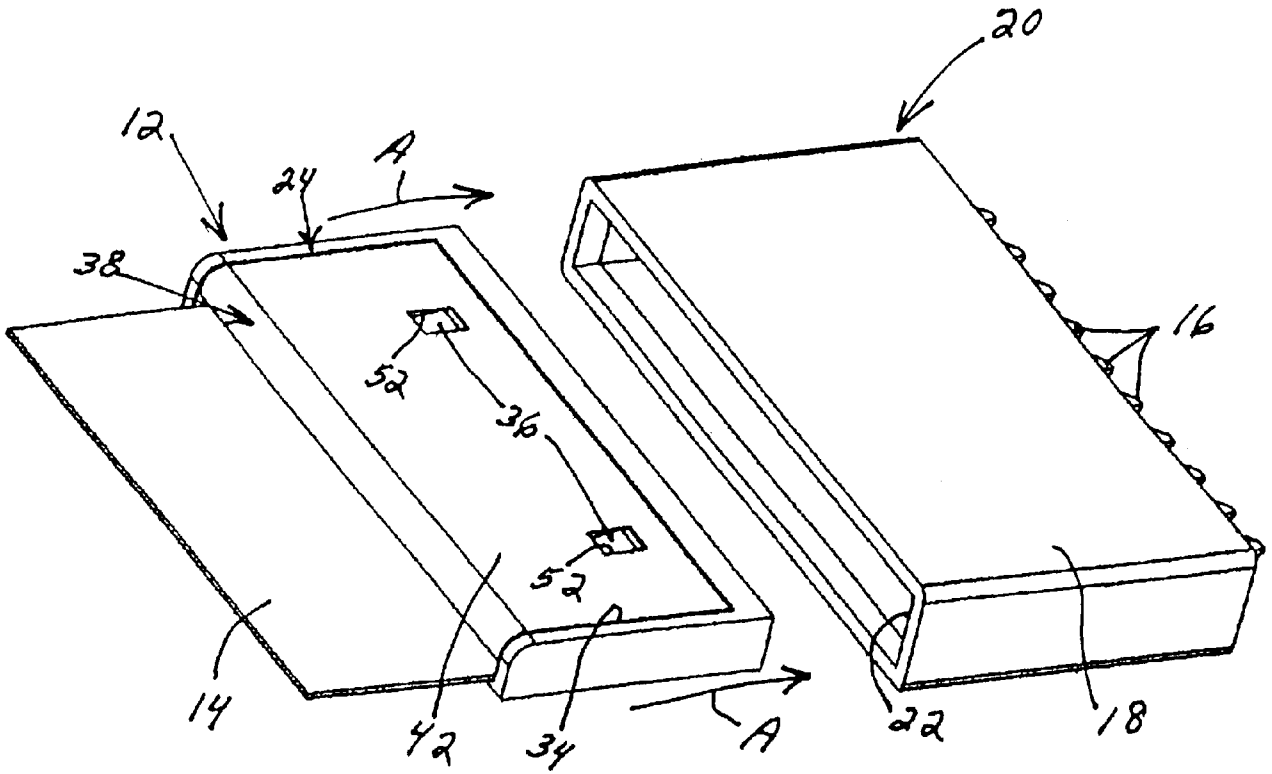
FIG. 2 is a bottom perspective view of the assembly of FIG. 1 in unmated condition.
Figure 14:
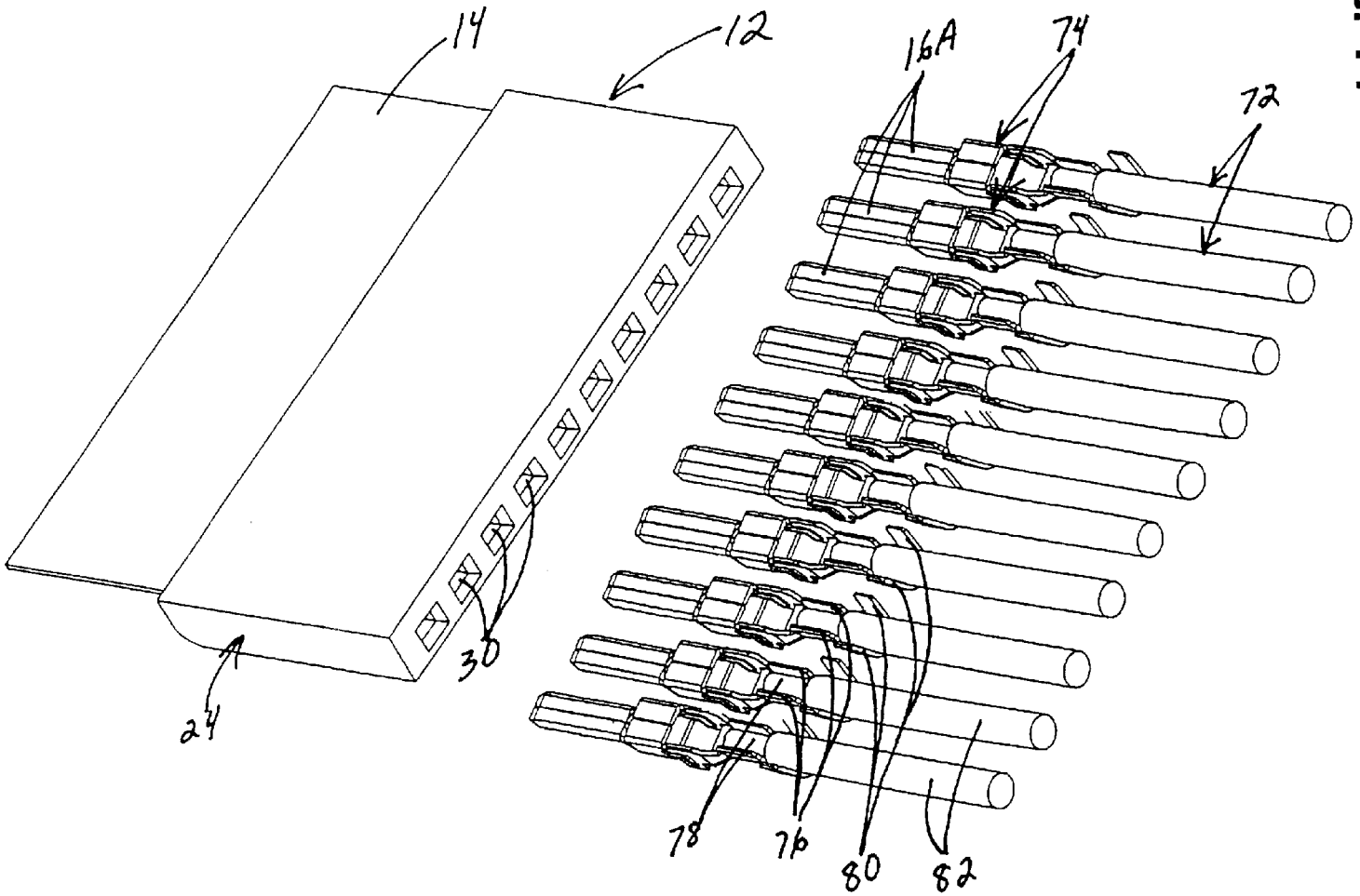
FIG. 14 is a view similar to that of FIG. 1, but the connector of the invention is shown for use with a plurality of discrete terminal pins individually crimped to a plurality of electrical conductors.

FIG. 14 shows an application of the invention wherein electrical connector 12 is used with a plurality of discrete terminal pins 16A respectively terminated to a plurality of discrete conductors, generally designated 32, rather than terminal pins 16 of header connector 20 (FIG. 1). In other words, terminal pins 16A (FIG. 14) comprise portions of a plurality of male terminals, generally designated 74. Each male terminal 74 includes a pair of crimp arms 76 which are clamped to the interior core or wire 78 of a respective conductor 72. Each male terminal 74 also includes a pair of crimp arms 80 which are clamped onto the outer dielectric or insulating sheath 82 of the respective conductor. Of course, connector 12 of the invention can be used for mating with discrete terminal pins of a wide variety of electrical connecting devices, as exemplified by terminal pins 16 of header connector 20 and terminal pins 16A of male terminals 74.

FIGS. 15–21 show a second embodiment of the invention. In the first embodiment described above, the cam means defined by elongated cam ramps 56 are formed integrally within housing 24. In the second embodiment, the cam means is provided by a plurality of cam ramps on a preload member which is separate from the housing as will be seen below.

Specifically, a second embodiment of an electrical connector, generally designated 84 (FIG. 15), includes a dielectric housing, generally designated 86, which defines a front mating end 88 and a rear terminating end 90 for receiving flat flexible circuit 14. The conductors of the circuit are terminated to a plurality of terminal pins which are inserted into three pin receiving passages 92 at front mating end 88 of the connector.

Figure 16:
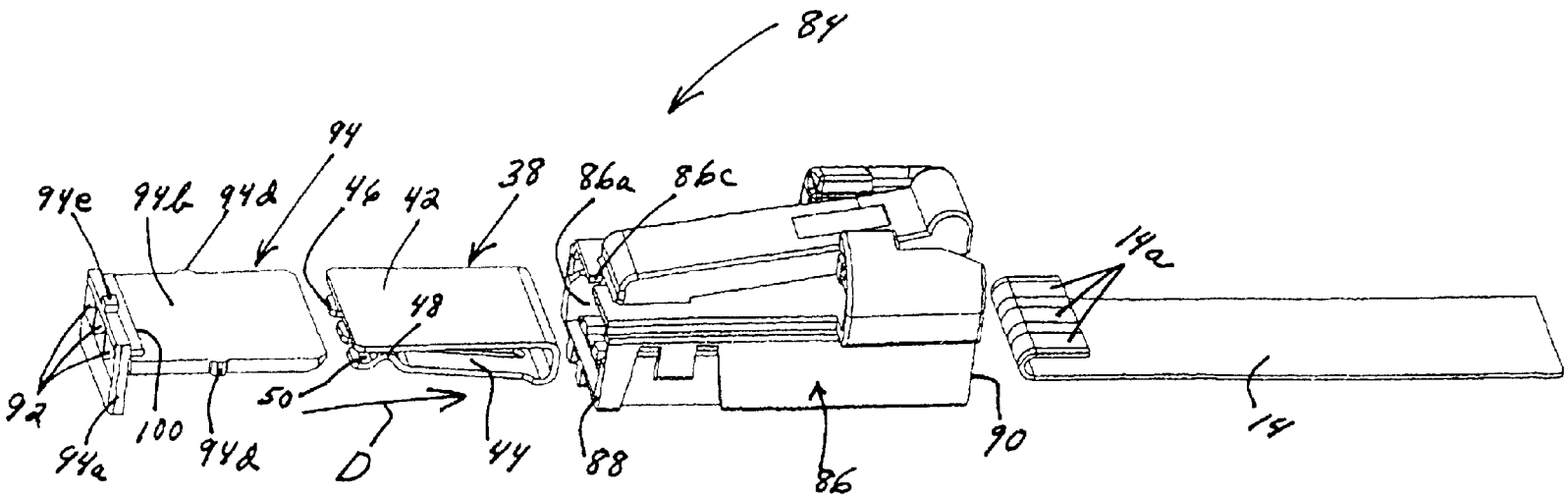
FIG. 16 is an exploded perspective view of the connector of FIG. 15.

FIG. 16 basically shows that connector 84, in addition to housing 86, includes a circuit carrier or spring member, generally designated 38, and a separate preload member, generally designated 94. The preload member and the circuit carrier or spring member are inserted into a cavity 86*a* in housing 18 in the direction of arrow "D", the cavity being open at front mating end 88 of the housing.

Spring member 38 is very similar to circuit carrier 38 of the first embodiment as described above in relation to FIGS. 7 and 8. In particular, spring member 38 (FIG. 16) is fabricated of metal material having spring loading capabilities. The spring member is generally U-shaped to define a top wall 42 and a bottom wall which is comprised of a plurality (three) of flexible or resilient fingers 44. The fingers combine to define a composite leading edge 46. The fingers have raised areas 48 which face inwardly toward top leg 42. The raised areas define convex surfaces which form contact portions behind conductors 14*a* of flat flexible circuit 14 for providing good engagement with the terminal pins which are inserted into pin receiving passages 92. A mouth 50 is defined between the distal ends of top wall 42 and fingers 44 at edge 46.

Figure 15:
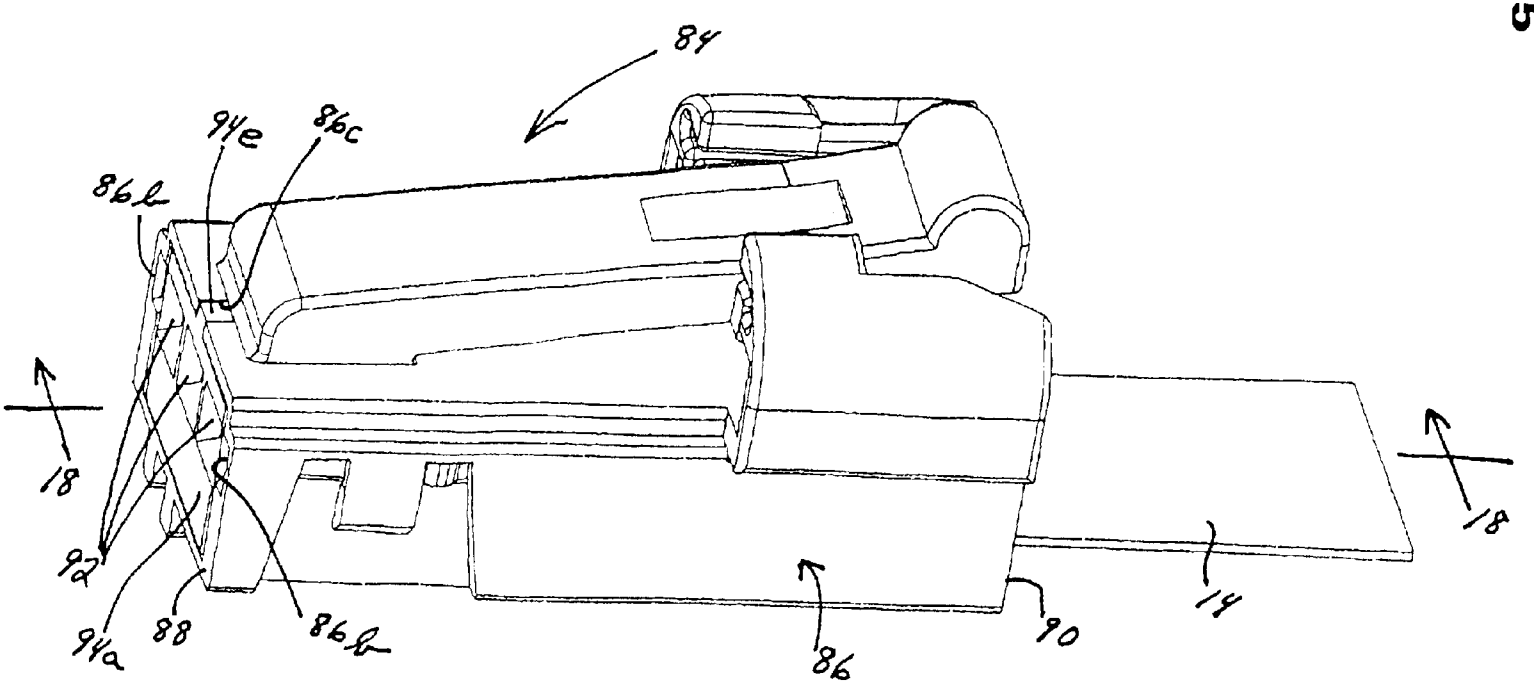
FIG. 15 is a perspective view of a second embodiment of a connector according to the invention.
Figure 17:
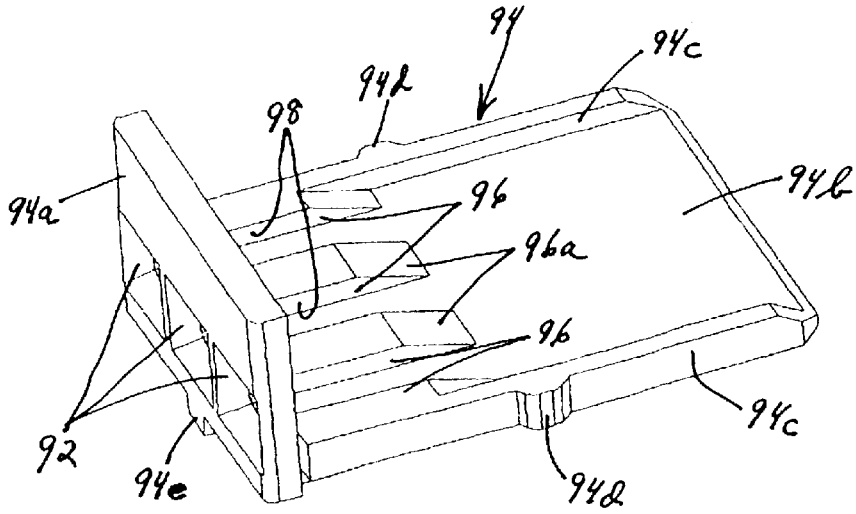
FIG. 17 is a perspective view of the separate preload member of the connector of FIGS. 15 and 16.

Referring to FIG. 17 in conjunction with FIGS. 15 and 16, preload member 94 includes a front face plate 94*a* and a rearwardly extending, generally planar platform 94*b*. A pair of guide flanges 94*c* are formed along opposite edges of platform 94*b*. A pair of detent bosses 94*d* project outwardly from the outsides of guide flanges 94*c*. A polarizing boss 94*e* projects from one edge of face plate 94*a*. A plurality of cam ramps 96 project rearwardly of face plate 94*a* along platform 94*b*. The cam ramps have chamfered or angled surfaces 96*a*. The cam ramps are spaced laterally of platform 94*b* to define slots 98 therebetween. The slots are aligned with passages 92. The entire preload member may be unitarily molded of plastic material.

When preload member 94 is inserted into cavity 86*a* of housing 86, guide flanges 94*c* at opposite sides of the preload member ride in a pair of guide grooves 86*b* (FIG. 15) at opposite sides of cavity 86*a* in housing 86. When the preload member is fully inserted into the housing, face plate 94*a* of the preload member is generally flush with front mating end 88 of housing 86 as seen in FIG. 15. Positioning boss 94*e* of the preload member moves into a positioning notch 86*c* at the top front of the housing.

Once preload member 94 is fully inserted into housing 86, the terminal pin receiving passages 92 of connector 14 actually are in face plate 94*a* of the preload member rather than in the connector housing. The pin receiving passages are aligned with slots 98 (FIG. 17) between cam ramps 96. Therefore and conversely, cam ramps 96 will be disposed between the terminal pins which are inserted into passages 92. Still further, when flat flexible circuit 14 is mounted within the connector, conductors 14*a* are aligned with terminal pin receiving passages 92. Still further, three flexible fingers 44 (FIG. 16) of spring member 38 will be aligned with both pin receiving passages 92 in spring member 94 as well as conductors 14*a* of flat flexible circuit 14.

Figure 18:
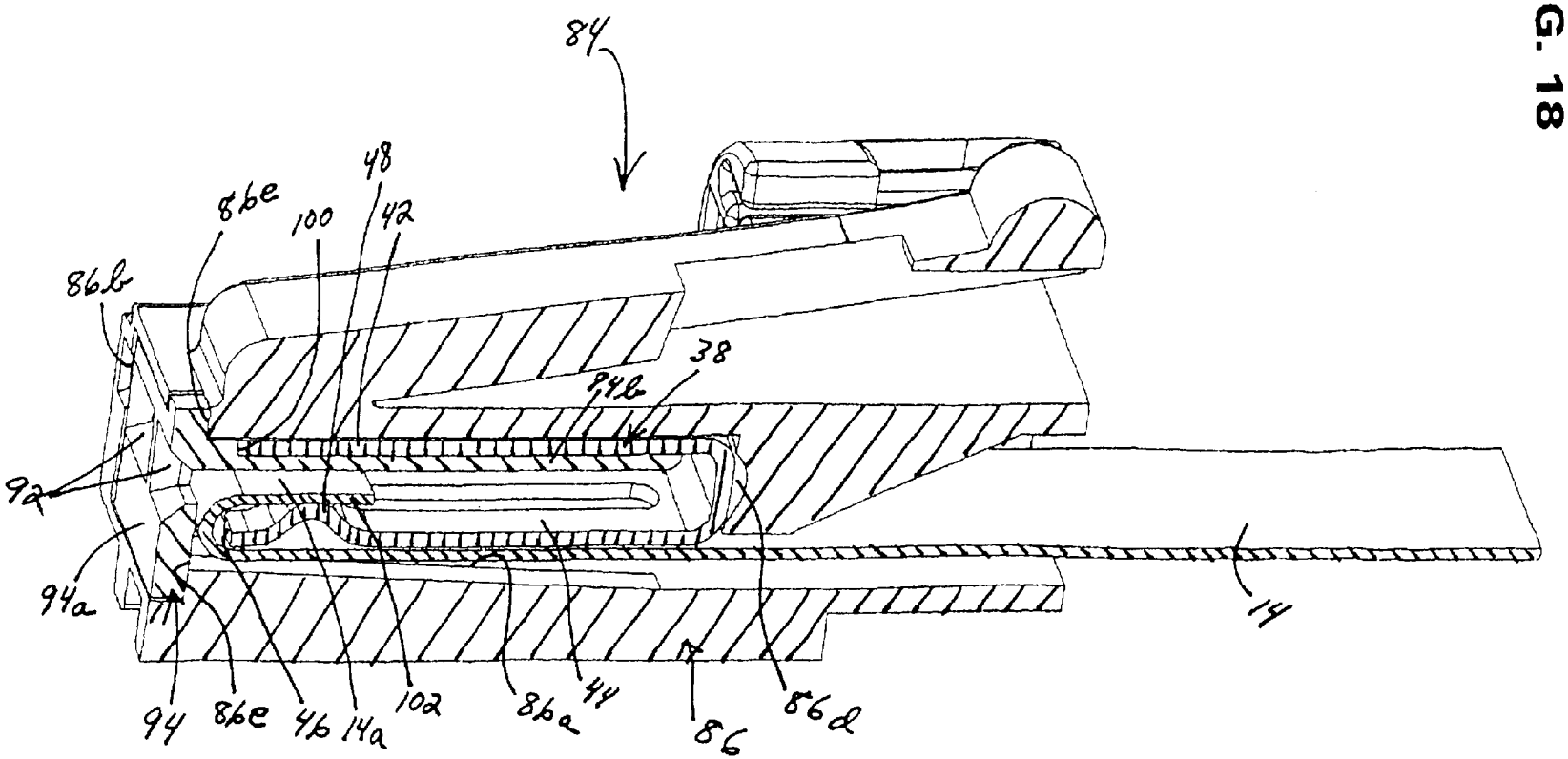
FIG. 18 is a vertical section taken generally along line 18—18 of FIG. 15.

FIG. 18 shows a section with connector 84 fully assembled, i.e., with flat flexible circuit 14, spring member 38 and preload member 94 all mounted within connector housing 86. It can be seen that spring member 38 bottoms out against an interior wall 86*d* of cavity 86*a* within connector housing 86. A front edge of top wall 42 of the spring member abuts against a shoulder 100 of the preload member when the preload member is fully inserted into the housing. When the preload member is fully inserted, face plate 94*a* thereof abuts against stop shoulders 86*e* of housing 86. A distal end 102 of flat flexible circuit 14 is wrapped about composite edge 46 defined by flexible fingers 44 of spring member 38, with conductors 14*a* of the circuit facing away from edge 46 and toward passages 92 in preload member 94 which receive the terminal pins.

Figure 19:
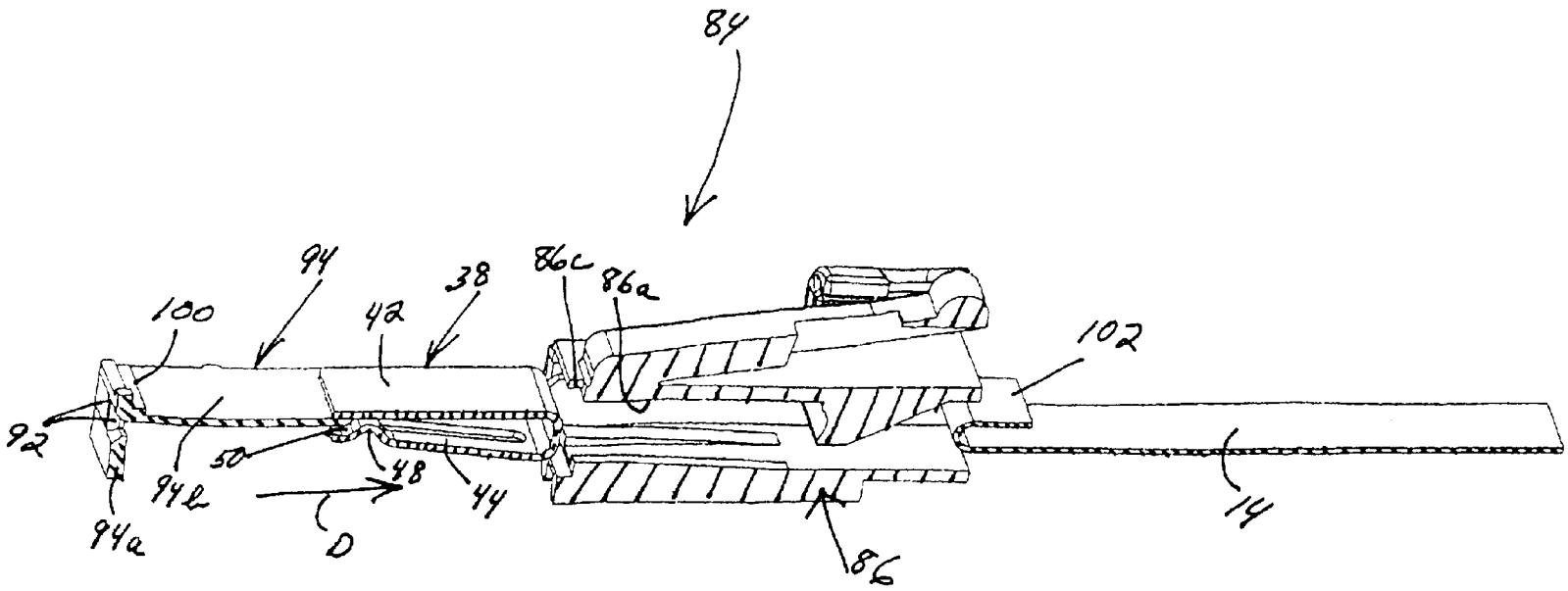
FIG. 19 is a vertical section of the connector in exploded condition.

Spring member 38 and preload member 94 may be inserted into cavity 86*c* of housing 86 independent of each other with the preload member retained in a preload position as described hereinafter. On the other hand, and referring to FIG. 19, since the front edge of top wall 42 engages shoulder 100 of the preload member in the final assembled condition of the connector, the preload member could be used to load or mount the spring member within the housing. This is shown in FIG. 19 wherein platform 94*b* of the preload member is being inserted into mouth 50 of the spring member in the direction of arrow "D. The preload member is moved until shoulder 100 engages the front edge of top wall 42 of the spring member, and the preload member and spring member can be conjointly moved into cavity 86*c* to completely mount the spring member thereinto. The preload member then can be moved back out to its preload position described hereinafter, while all of the interference forces surrounding the spring member within cavity 86 of the housing retains the spring member in its fully mounted position.

Figures 20A, 20B, 20C:
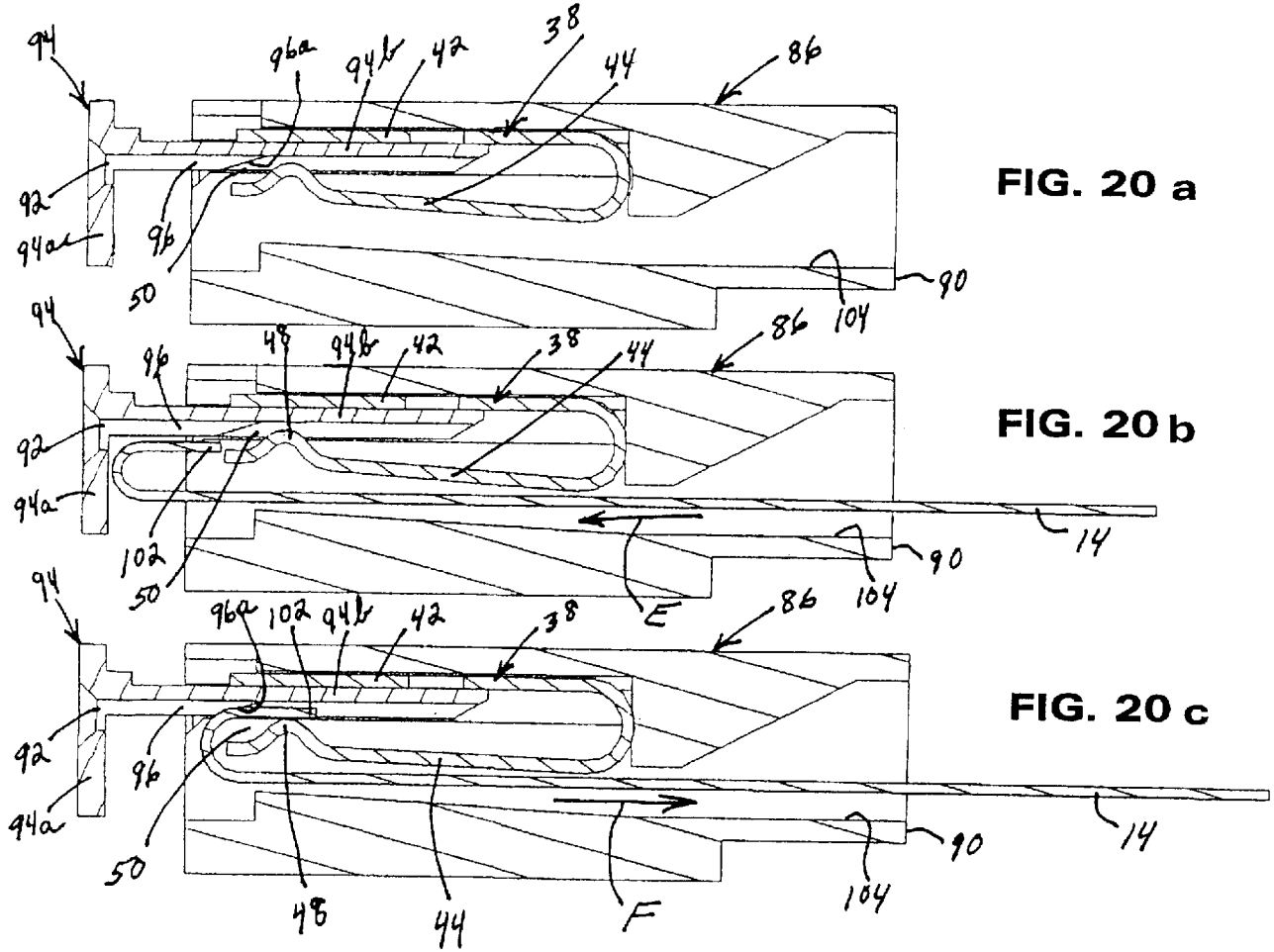
FIGS. 20A–20D are sequential sectional views showing the movement of the preload member in conjunction with assembling a flat flexible circuit in the connector of FIGS. 15–19.
Figure 20D:
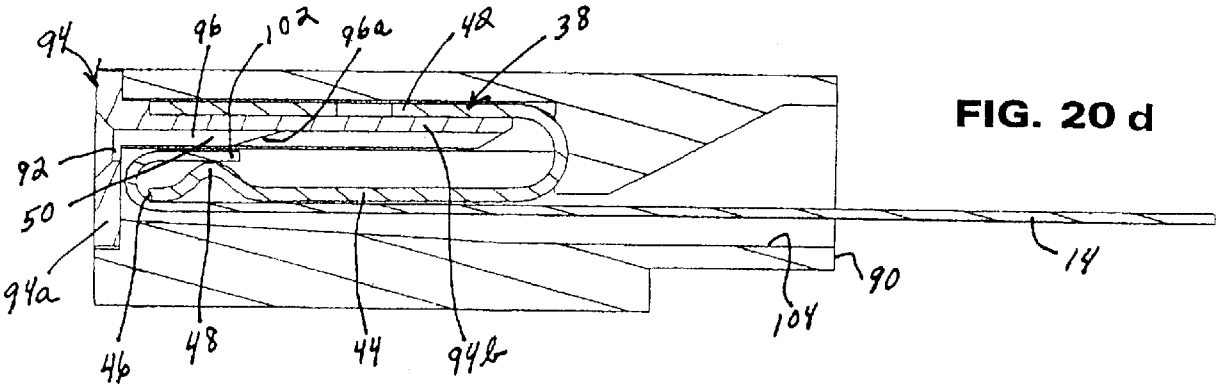

FIGS. 20A–20D show the procedures normally followed in terminating flat flexible circuit 14 in connector 84. In essence, preload member 94 is movably mounted within cavity 86*a* of housing 86 as described above, and the preload member is movable between a preassembly position shown in FIGS. 20A–20C to a preload position shown in FIG. 20D. In the preassembly position, cam ramps 96 are completely out of engagement with any portions of spring member 38 as can be seen in FIG. 20A. FIG. 20D shows the "preload" position which will be described below, but the preload position corresponds to the fully assembled position of the preload member as described above in relation to FIGS. 15 and 18.

FIG. 20B shows flat flexible circuit 14 having been inserted in the direction of arrow "E" into an opening 104 in rear terminating end 90 of housing 86 until distal end 102 of the circuit is located behind face plate 94*a* of the preload member. In actual practice, the flat flexible circuit cannot be bent completely into the U-shaped configuration shown in FIG. 20B. However, distal end 102 of the circuit can be bent at an angle extending upwardly of the circuit so that when the circuit is inserted into the connector, distal end 102 will abut against the rear surface of face plate 94*a* of the preload member and continue to bend generally into the U-shape as shown by continued pushing onto the flat flexible circuit. It can be seen that cam ramps 96 still are not in engagement with any portions of spring member 38 in the position of FIG. 20B while the flat flexible circuit is being inserted into the connector.

Flexible circuit 14 then is pulled back rearwardly in the direction of arrow "F" in FIG. 20C. It can be seen that angled surfaces 96*a* of cam ramps 96 are considerably spaced from raised areas 48 of flexible fingers 44 of spring member 38 at mouth 50. Distal end 102 of the flat flexible circuit enters mouth 50 and rides up onto the tops of raised areas 48 as shown in FIG. 20C. With most flat flexible circuits having a substrate fabricated of polyester material, distal end 102, being bent as described above in relation to FIG. 20B, will remain stiff enough to enter and move into mouth 50 onto the tops of raised areas 48.

FIG. 20D shows preload member 94 having been moved to its completely assembled and preload position. In this position, cam ramps 96 engage the top of distal end 102 of flat flexible circuit 14 and bias the circuit against raised areas 48 of flexible fingers 44 of spring member 38. In essence, with platform 94*b* of preload member 94 engaging the inside of top wall 42 of spring member 38, the top wall of the spring member is fixed, and cam ramps 96 are effective to spread flexible fingers 44 away from top wall 42. Because of the engagement of cam ramps 96 with distal end 102 of the flat circuit, the distal end, in turn, is biased into engagement with raised areas 48 of flexible fingers 44. This slightly opens mouth 50 between top wall 42 and spring fingers 44 to effectively convert the mouth into a spring loaded mouth and apply a given contact force to the terminal pins inserted into passages 92 and between cam ramps 96.

Figure 21:
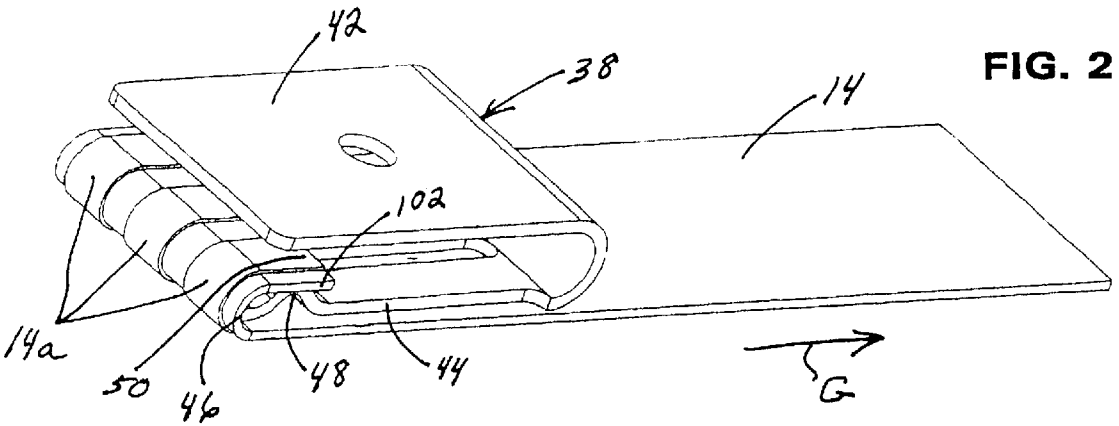
FIG. 21 is an isolated view of the spring member and flat flexible circuit to show the positional relationship therebetween when the circuit is fully mounted in the connector.

Finally, FIG. 21 shows spring member 38 in conjunction with flat flexible circuit 14 to show distal end 102 of the circuit wrapped around edge 46 defined by flexible fingers 44. Although the edge is shown spaced from the flat flexible circuit in such views as FIG. 18, edge 46 is a thin, abrupt edge about which the flat flexible circuit is wrapped. This thin edge provides an interference engagement with the back side of the flat flexible circuit to retain the circuit should pulling forces be applied to the circuit in the direction of arrow "G" (FIG. 21) once the circuit is fully terminated within the connector.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A connector for electrically interconnecting conductors of a flat flexible circuit to a plurality of terminal pins, comprising:

a dielectric housing having a front mating end for receiving the flat flexible circuit;

a spring member in the housing for supporting the flat flexible circuit with the conductors facing away therefrom for engaging the terminal pins inserted into the mating end of the housing and including a spring loaded mouth into which the terminal pins are inserted into engagement with the conductors of the circuit; and cam means engageable with the spring member to open said spring loaded mouth a given amount to apply a given contact force between the terminal pins and the conductors of the circuit.

2. The connector of claim 1 wherein said cam means is on a preload member separate from the dielectric housing.

3. The connector of claim 2 wherein said preload member is mounted on the housing for movement between a preassembly position wherein the cam means is out of engagement with the spring member and a preload position wherein the cam means is in engagement with the spring member to open said spring loaded mouth.

4. The connector of claim 3 wherein said preload member is slidably mounted in an opening at the front mating end of the housing for movement between said positions.

5. The connector of claim 4 wherein said preload member includes a plurality of terminal pin receiving passages.

6. The connector of claim 5 wherein the conductors of said flat flexible circuit are spaced laterally thereof, and the terminal pin receiving passages in the preload member are aligned with the conductors.

7. The connector of claim 6 wherein said cam means comprise a plurality of individual cams located between the terminal pin receiving passages.

8. The connector of claim 3, including detent means between the preload member and the housing to hold the preload member in at least one of its positions.

9. The connector of claim 3, including detent means between the preload member and the housing to hold the preload member in either of said preassembly or preload positions.

10. The connector of claim 1 wherein at least a portion of said spring member is generally U-shaped to define a pair of legs, a first of said legs comprising a support portion of the spring member for supporting the flat flexible circuit, and a second of said legs comprising a mounting portion for mounting the circuit carrier to the housing.

11. The connector of claim 10 wherein said first leg of the circuit carrier has a leading edge about which the flat flexible circuit is wrapped with the conductors of the circuit facing away therefrom.

12. The connector of claim 11 wherein said leading edge is a thin edge providing an interference engagement with the flat flexible circuit to retain the circuit supported by the spring member.

13. The connector of claim 1 wherein said cam means is on said dielectric housing.

14. The connector of claim 1 wherein said spring member includes a thin edge about which the flat flexible circuit is wrapped, the thin edge providing an interference engagement with the flat flexible circuit to retain the circuit supported by the spring member.

15. A connector for electrically interconnecting conductors of a flat flexible circuit to a plurality of discrete terminal pins, comprising:

a dielectric housing having a front mating face and a rear terminating face, a plurality of terminal pin receiving passages in the mating face and a flat circuit receiving receptacle in the terminating face, the receptacle communicating with the passages;

a circuit carrier insertable into said receptacle of the housing and including an attachment portion for attaching the flat flexible circuit to the carrier with the conductors of the circuit facing away from the carrier toward the terminal pin receiving passages, whereby insertion of the terminal pins in the passages causes the terminal pins to engage the conductors of the circuit, said circuit carrier including a spring loaded mouth into which the terminal pins are inserted into engagement with the conductors of the circuit; and cam means engageable with the circuit carrier to open said spring loaded mouth a given amount to apply a given contact force between the terminal pins and the conductors of the circuit.

16. A connector for electrically interconnecting the conductors of a flat flexible circuit to a plurality of discrete terminal pins, comprising:

a dielectric housing having a front mating face and a rear terminating face, a plurality of terminal pin receiving passages in the mating face and a flat circuit receiving receptacle in the terminating face, the receptacle communicating with the passages;

a generally U-shaped circuit carrier insertable into said receptacle of the housing and including a pair of legs, a first of said legs defining an attachment portion for attaching the flat flexible circuit to the carrier with the conductors of the circuit facing away from the carrier toward the terminal pin receiving passages, and a second of said legs comprising a mounting portion for mounting the circuit carrier to the housing, the legs including distal ends defining a mouth at which the flat flexible circuit is attached for engaging the terminal pins inserted into said passages and inside the mouth, the circuit carrier being spring loaded at said mouth; and cam means engageable with at least one of the legs to open the mouth a given amount to apply a given contact force between the terminal pins and the conductors of the circuit.

17. The connector of claim 16 wherein said cam means comprises at least one cam ramp on the housing for opening said mouth automatically in response to inserting the circuit carrier into the receptacle of the housing.

18. A connector for electrically interconnecting conductors of a flat flexible circuit to a plurality of discrete terminal pins, comprising:

a dielectric housing having a front mating face and a rear terminating face, a plurality of terminal pin receiving passages in the mating face and a flat circuit receiving receptacle in the terminating face, the receptacle communicating with the passages;

a metal circuit carrier insertable into said receptacle of the housing, at least a portion of the circuit carrier being generally U-shaped to define a pair of legs, a first of said legs having a leading edge about which the flat flexible circuit is wrapped with the conductors of the circuit facing away therefrom toward the terminal pin receiving passages, a second of said legs comprising a mounting portion for mounting the circuit carrier to the housing, and distal ends of the legs defining a spring loaded mouth into which the terminal pins are inserted into engagement with the conductors of the flat flexible circuit; and cam means on the housing engageable with at least one of the legs to open the mouth a given amount to apply a given contact force between the terminal pins and the conductors of the circuit.

19. The connector of claim 18 wherein said cam means comprises at least one cam ramp on the housing for opening said mouth automatically in response to inserting the circuit carrier into the receptacle of the housing.

20. The connector of claim 19 wherein said second leg of the circuit carrier is fixed to the housing, and the first leg is moved by said cam ramp to open said mouth.

21. A connector for electrically interconnecting the conductors of a flat flexible circuit to a plurality of terminal pins, comprising:

a housing having a front mating end for receiving the terminal pins and a rear terminating end for receiving the flat flexible circuit;

a circuit carrier insertable into the rear terminating end of the housing for supporting the flat flexible circuit with the conductors facing away therefrom for engaging the terminal pins inserted into the mating face of the housing, the circuit carrier including a spring loaded mouth into which the terminal pins are inserted into engagement with the conductors of the circuit; and cam means on the housing engageable with the circuit carrier to open said spring loaded mouth a given amount to apply a given contact force between the terminal pins and the conductors of the circuit.

22. The connector of claim 21 wherein at least a portion of said circuit carrier is generally U-shaped to define a pair of legs, a first of said legs comprising a support portion of the carrier for supporting the flat flexible circuit, and a second of said legs comprising a mounting portion for mounting the circuit carrier to the housing, said legs having distal ends defining said spring loaded mouth.

23. The connector of claim 21 wherein said cam means comprises at least one cam ramp on the housing for opening said mouth automatically in response to inserting the circuit carrier into the mating face of the housing.

* * * * *